United States Patent [19]

Hanson, Sr.

[11] 4,112,638

[45] Sep. 12, 1978

[54] SKIRT MOUNTING DEVICE FOR MOBILE HOMES

[75] Inventor: Paul D. Hanson, Sr., Minneapolis, Minn.

[73] Assignee: Technical Plastics Corporation, St. Paul, Minn.

[21] Appl. No.: 778,575

[22] Filed: Mar. 17, 1977

[51] Int. Cl.[2] ..... E02D 27/00

[52] U.S. Cl. ..... 52/169.12; 52/122; 52/165; 52/DIG. 3

[58] Field of Search ..... 52/DIG. 3, 169.12, 632, 52/122, 243, 241, 298, 112, 239, 165

[56] References Cited

U.S. PATENT DOCUMENTS

| | | | |
|---|---|---|---|
| 239,080 | 3/1881 | Baker | 52/298 |
| 681,326 | 8/1901 | Kinnear | 52/632 |
| 1,083,582 | 1/1914 | Bates | 52/165 |
| 3,083,795 | 4/1963 | Land | 52/632 |
| 3,216,741 | 11/1965 | Newlin | 52/169.12 |
| 3,256,655 | 6/1966 | Teeter | 52/169.12 |
| 3,453,790 | 7/1969 | Harris | 52/122 |
| 3,537,218 | 11/1970 | Hindman | 52/169.12 |
| 3,900,182 | 8/1975 | Berman | 52/632 |
| 3,998,025 | 12/1976 | Nestroy | 52/122 |

*Primary Examiner*—Ernest R. Purser
*Assistant Examiner*—Henry E. Raduazo
*Attorney, Agent, or Firm*—Schroeder, Siegfried, Ryan, Vidas & Steffey

[57] ABSTRACT

Adjustable means for mounting skirting panels about a mobile home which may include a rigid mounting socket to be secured to the mobile home, a longitudinally adjustable stud, and a combined sleeve and base stake slidably mounted on the stud and fixedly secured to the stud after the base stake is first driven into the ground while so mounted, to fix the stud and sleeve relative to the ground.

14 Claims, 5 Drawing Figures

SKIRT MOUNTING DEVICE FOR MOBILE HOMES

It is a general object of my invention to provide a novel and improved means for mounting skirting panels about the lower periphery of a mobile home.

A more specific object is to provide novel and inexpensive mounting brackets which can be utilized, if desired, with simple wooden studs to provide secure and readily assembled mountings for skirting panels or can be utilized with adjustable studs to accommodate variations in terrain.

Another object is to provide a novel and improved stud mounting for skirting panels which are capable of ready adjustment to accommodate terrain variations.

These and other objects and advantages of my invention will more fully appear from the following description, made in connection with the accompanying drawings, wherein like reference characters refer to the same or similar parts throughout the several views, in which.

Figure 1:
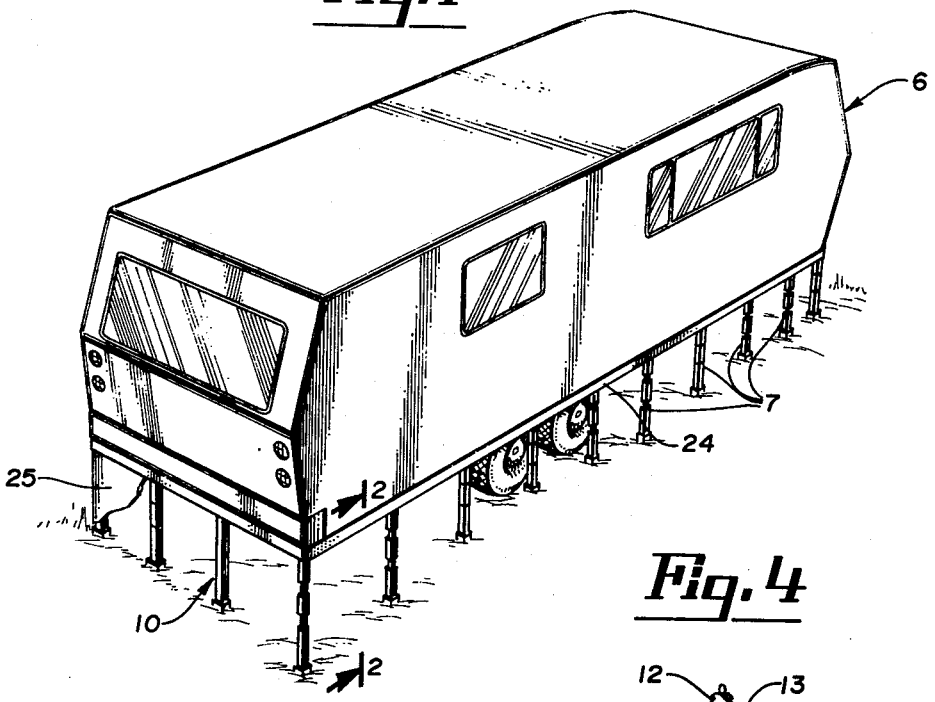
FIG. 1 is a perspective view of a mobile home with a plurality of my mounting devices secured to the underside thereof along its periphery, illustrating their placement preparatory to securing skirting panels thereto.
Figure 4:
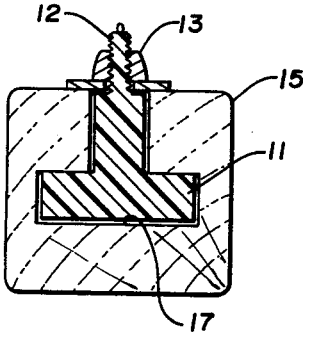
FIG. 4 is a horizontal sectional view taken on an even larger scale along line 4—4 of FIG. 3.
Figure 2:
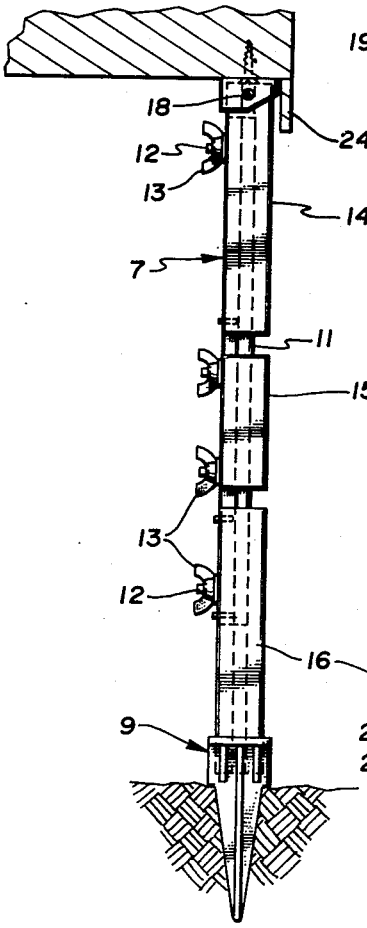
FIG. 2 is a side elevational view on an enlarged scale of one of the mountings taken along line 2—2 of FIG. 1.
Figure 3:
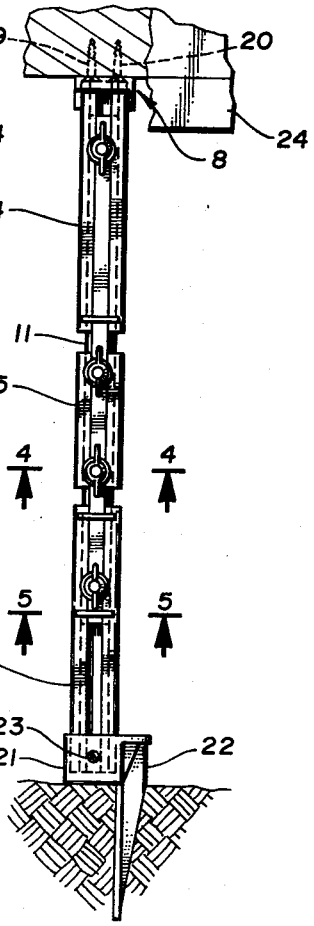
FIG. 3 is a rear elevational view of the mounting shown in FIG. 2.
Figure 5:
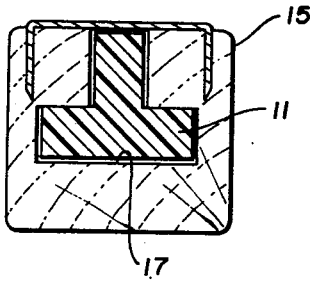
FIG. 5 is a horizontal sectional view taken on a similar scale to that shown in FIG. 4 and along line 5—5 of FIG. 3.

In FIG. 1, there is a shown a mobile home 6 having a plurality of my mounting studs 7 connected thereto along its underside and along the periphery thereof. Each of the studs 7 is secured at its upper end by a mounting socket 8 which is best shown in FIGS. 2 and 3. At its lower end, each of the studs 7 is secured to the ground by a combined sleeve and base stake identified generally by the numeral 9. A plurality of such mountings makes it a simple matter to secure skirting panels firmly in the proper position desired.

The studs 7 may, if desired, each consist of a single elongated piece of wood which is 2 × 2 inches in cross-sectional dimensions. When such a stud is utilized, the invention in its simplest form is demonstrated, for such wood material may be readily purchased at any lumber yard and the mounting bracket 8 and combined sleeve and base stake 9 may be manufactured, packaged and sold as a unit to the mobile home owner for use in conjunction with such a simple wooden stud. One of such a simple wooden stud has been identified by the numeral 10 in FIG. 1; whereas, the remainder of the studs illustrated in that figure are of the type shown in detail in FIGS. 2–5.

An alternative and preferred stud 7 may be in the form shown in detail in FIGS. 2–5 and consists of an elongated shank member 11 which is T-shaped in cross-sectional configuration and is preferably made of a thermoplastic material such as polypropylene. Each of the shank members 11 carries a plurality of externally threaded projections 12 which in turn carry flanged nuts 13.

Such an alternative stud 7 also includes the plurality of mounting members identified by the numerals 14–16, inclusive, which are slidably mounted on the shank member 11. Each of these mounting members 14–16 are made from 2 × 2 inch studs and are shorter in length than the shank member 11. Each has a way or slot 17 formed in the backside thereof and extending throughout its length. The ways 17 are T-shaped in cross-sectional configuration and complement the T-shaped shank member in shape and are slightly larger in dimensions so that each of the mounting members is free to slide longitudinally relative to the shank 11 to any desired position and to be secured thereat by its associated nut 13.

The upper end of the stud 7 is secured to the underside of the mobile home 6 along its periphery by means of one of the mounting sockets 8. Such a socket 8 has interior dimensions such that it fits snugly around the upper end of the stud 7, in the case of the adjustable stud shown in FIGS. 2 and 3, this being the mounting member 14. Each of the mounting brackets 8 is provided with a set screw 18 by means of which the upper end of the mounting member 14 or the solid wood stud is rigidly affixed to the mounting socket 8. Each of these sockets is provided with a pair of openings in its base wall through which a pair of screws 19 and 20 extend to secure the socket to the underside of the mobile home 6.

The lower mounting member 16 and the shank member 11 are secured to the ground by means of the combined sleeve and base stake 9. This member 9 is comprised of a sleeve member 21 which has a square bore of dimensions only slightly larger than the 2 × 2 inch stud and is slidably received on the lower end portion of the mounting member 16. The base stake member 22 is integrally formed with the sleeve member 21 and extends downwardly therefrom and is positioned entirely outside the confines of the bore of the sleeve. A set screw 23 is provided to fixedly secure the sleeve 21 to the mounting member 16 after the combined sleeve and base stake have been permanently located relative to the ground.

The mounting socket 8 and the combined sleeve and base stake 9 are made of thermoplastics such as polypropylene or acrylonitrile-butadiene-styrene (ABS).

In use, the mounting sockets 8 are secured to the underside of the mobile home 6 along its periphery just inwardly of the depending flange 24 which is found on most mobile homes. They are secured, as shown in FIGS. 2 and 3, by the screws 19 and 20 and, thereafter, the studs 7 are inserted within the mounting sockets and secured thereto with the set screws 18. Before inserting the studs 7, the sleeve members 21 of the combined sleeve and base stake 9 are first slid onto the lower end of the study to an intermediate position so that the base stake will clear the ground. Once the stud has been located within the socket 8 and secured thereto by the set screw 18, the sleeve 21 is slid downwardly along the stud until the base stake 22 engages the ground. At this point, the base stake is driven into the ground until the sleeve 21 approaches the same. In this manner, both the stud 7 and sleeve 21 are fixed relative to the ground and since the upper end of the stud is secured by the mounting socket 8, a firm and rigid mounting is provided for the skirting panels 25 which may be secured to the studs by conventional staples, or screws.

It will be readily understood that when the adjustable stud 7, shown in FIGS. 2–5, inclusive, are utilized, considerable more leeway is available with respect to variations in terrain. The length of the stud 7 may be readily adjusted and extended by releasing the uppermost nut 13 and sliding the mounting member 14 upwardly beyond the end of the shank 11, as shown in FIG. 3. Similarly, the lowermost mounting member 16 may be adjusted relative to the shank member 11 so that the lower end thereof extends downwardly beyond the lower end of the shank, as is also shown in FIG. 3. Thus, it is possible through the use of the adjustable stud shown in FIGS. 2–5 to utilize the mounting socket 8 and combined sleeve and base stake 9 in almost any terrain conditions normally encountered. Of course, the simplest form of the invention would be the use of the solid 2 × 2 inch wooden stud 7 which is nonextensible and is more limited in its versatility because it requires a more even terrain.

Thus, it can be seen that I have provided a simple but very inexpensive and yet convenient means of mounting skirting panel around the lower edge of a mobile home. Through the use of my invention, a very substantial savings in time and material, as well as effectivenesss, can be accomplished for the appearance and rigidity of the panels when so mounted is substantially enhanced.

It will, of course, be understood that various changes may be made in the form, details, arrangement and proportions of the parts without departing from the scope of my invention which consists of the matter shown and described herein and set forth in the appended claims.

What I claim is:

1. A longitudinally adjustable skirt mounting device for mobile homes and the like, comprising:

(a) an elongated rigid shank member having upper and lower end portions;

(b) a plurality of mounting members each shorter than said shank member and slidably mounted thereon for relative longitudinal movement therebetween;

(c) releasable securing means associated with said shank member and said mounting members to permit adjustment of the position of the latter along the length of said shank member and securing the same thereat;

(d) at least some of said mounting members having portions thereof made of material adapted to have skirting panels secured thereto;

(e) a sleeve member adapted to telescopingly receive the lower end portion of the lowest of said mounting members therein in close-fitting relation and to be slid upwardly therealong;

(f) a base stake fixedly carried by said sleeve member at one side thereof and extending downwardly therefrom to fix said sleeve member and said shank member to the ground when said base stake is extended thereinto;

(g) a rigid mounting socket adapted to receive the upper end of the uppermost of said mounting members therein in close-fitting relation;

(h) means for rigidly affixing said mounting socket to the upper end of said uppermost of said mounting members when the latter is so received therein; and (i) said mounting socket being adapted to be fixedly secured to the underside of such a mobile home adjacent the periphery of the latter whereby skirting panels may be mounted upon and supported by said mounting members in desired position relative to the mobile home.

2. The structure defined in claim 1, and means carried by said sleeve member for fixedly securing the same to the lower end portion of the lowest of said mounting members after said base stake has been driven into the ground while the lower end portion of a said last mentioned member is so received within said sleeve member.

3. The structure defined in claim 1 wherein said shank member is T-shaped in cross-sectional configuration.

4. The structure defined in claim 1 wherein said shank member is T-shaped in cross-sectional configuration and said securing means is carried thereby.

5. The structure defined in claim 1 wherein said shank member is T-shaped in cross-sectional configuration and each of said mounting members is made of wood and has a T-shaped way formed therein and extending longitudinally throughout its length and receiving said shank member within its said way for relative movement longitudinally thereof.

6. The structure defined in claim 1 wherein said sleeve member and said base stake are rigid and integrally formed of a thermoplastic material such as polypropylene.

7. The structure defined in claim 1 wherein each of said sleeve members, base stake and mounting socket is rigid and formed of a thermoplastic material.

8. The structure defined in claim 7 wherein said thermoplastic material is either polypropylene or acrylonitrile-butadiene-styrene.

9. The structure defined in claim 1 wherein said mounting members are made of wood.

10. The structure defined in claim 1 wherein said base stake extends parallel to the axis of said sleeve member and is disposed entirely outside the confines of the bore thereof.

11. A longitudinally adjustable skirt mounting device for mobile homes and the like, comprising:

(a) an elongated rigid stud having upper and lower ends and being adapted to have skirting panels secured thereto;

(b) a rigid mounting socket adapted to receive the upper end of said stud therein in close-fitting relation;

(c) means carried by said socket for rigidly affixing the same to the upper end of said stud when the latter is so received threin;

(d) said mounting socket being adapted to be fixedly secured to the underside of such a mobile home adjacent the periphery of the latter whereby skirting panels may be mounted upon and supported by said stud in desired position relative to the mobile home when said stud is so received;

(e) an open-ended slidable sleeve member constructed and arranged to telescopingly receive the lower end of said stud therein in close-fitting relation and to be slid longitudinally to various positions between the ends thereof and to be readily secured thereat; and (f) a base stake fixedly carried by said sleeve member at one side thereof and extending downwardly therefrom to fixedly secure said sleeve member and said stud to the ground when said base stake is extended thereinto.

12. The structure defined in claim 11, and means carried by said sleeve member for fixedly securing the same to the lower end portion of said stud after said base stake has been driven into the ground while the lower end portion of said stud is so received within said sleeve member.

13. The structure defined in claim 11 wherein said stud is longitudinally adjustable.

14. The structure defined in claim 11 wherein said stud is made of wood throughout.

* * * * *